United States Patent [19]

Kotos

[11] 4,030,055

[45] June 14, 1977

[54] ELECTRIC CIRCUIT BREAKER WITH ELECTRO-MAGNETIC MEANS FOR OPPOSING MAGNETIC CONTACT-REPULSION FORCES

[75] Inventor: Peter Kotos, Havertown, Pa.

[73] Assignee: General Electric Company, Philadelphia, Pa.

[22] Filed: Feb. 27, 1976

[21] Appl. No.: 662,069

[52] U.S. Cl. ..... 335/195; 335/16; 335/147

[51] Int. Cl.[2] ..... H01H 77/10

[58] Field of Search ..... 335/195, 16, 147, 156, 335/15

[56] References Cited

UNITED STATES PATENTS

| | | | |
|---|---|---|---|
| 3,065,317 | 11/1962 | Streater | 335/16 |
| 3,225,160 | 12/1965 | Barkan | 335/156 |
| 3,366,900 | 1/1968 | Barkan | 335/15 |
| 3,663,906 | 5/1972 | Barkan et al. | 335/195 |
| 3,777,291 | 12/1973 | Kroon | 335/16 |

*Primary Examiner*—Harold Broome
*Attorney, Agent, or Firm*—William Freedman

[57] ABSTRACT

This circuit breaker comprises closing-assist means for opposing the contact-repulsion forces developed when a high current flows through the circuit breaker. This closing-assist means comprises spaced segments of high permeability material fixed to opposite sides of the usual movable contact rod and projecting laterally therefrom. Two stationary bridging members of high permeability material are located at opposite sides of said contact rod, and each extends between said segments when the contacts are engaged. The segments are located in proximity to but slightly spaced from the bridging members when the contacts are engaged so that said bridging members and said segments define a high permeability path around the contact rod containing short gaps between said segments and said bridging members. The flux resulting from current through the contact rod traverses said high permeability path and produces an attractive force between the bridging members and the segments acting on the segments in a direction to hold the contacts closed.

Opening-assist means of a construction similar to that of the above-described closing-assist means acts to assist an opening operation when the contacts are separated a short distance by an opening impact.

6 Claims, 4 Drawing Figures

ELECTRIC CIRCUIT BREAKER WITH ELECTRO-MAGNETIC MEANS FOR OPPOSING MAGNETIC CONTACT-REPULSION FORCES

BACKGROUND

This invention relates to an electric circuit breaker that comprises electromagnetic means for opposing the contact-repulsion forces developed when a high current flows through the circuit breaker.

When high current flows through the engaged contacts of a typical circuit breaker, high magnetic forces are developed that tend to force the contacts apart. As explained in more detail in U.S. Pat. No. 3,225,160-Barkan, assigned to the assignee of the present invention, these forces result primarily from the tendency of the current path to restrict at the point of contact engagement and, thus, to develop loop-shape components, each comprising arms extending along confronting faces of the contacts. Current through these loop shaped components creates a repulsive, contact-separating force between the arms of each loop. These contact-separating forces, which are referred to hereinafter as "contact-popping" forces, vary directly with the square of the current and, hence, can be very high when currents of short-circuit magnitude pass through the engaged contacts.

For opposing these contact-popping forces developed when high currents pass through the engaged contacts, various electromagnetic arrangements have been devised which act on the contacts to hold them engaged with a force also varying directly with the square of the current through the contacts. Typically, these electromagnetic arrangements have been rather complex and costly. For example, they have often required an electric circuit path of an involved configuration or have required that the opposing forces be transmitted through conductive braids or that there be special linkages and latches present. A problem usually present, and one which accounts for much of the above complexity, is in preventing the magnetic-assist means from unduly interfering with a circuit-breaker opening operation, which must usually be a high speed operation.

SUMMARY

An object of my invention is to provide, for holding the contacts closed against magnetic contact-repulsion forces, relatively simple magnetic-assist means that does not require an involved electric circuit configuration or complicated linkages.

Another object is to construct the magnetic-assist means in such a way that it does not unduly impede opening motion of the circuit breaker when such opening is desired.

Another object is to provide magnetic-assist means that can provide a magnetic force acting in an opening direction during an operation to assist in the opening operation.

In carrying out the invention in one form, I provide closing-assist means for exerting on the movable contact rod when the contacts are engaged a magnetic hold-closed force varying in magnitude directly with current through the contact rod. I also provide opening means effective during the initial portion of an opening operation for applying to the contact rod an impact force that acts to separate the contacts and to reduce the effectiveness of the closing-assist means. Opening-assist means effective after the contacts are separated during an opening operation is provided for developing magnetic force acting on the contact rod in an opening direction.

This opening-assist means comprises: (i) two spaced segments of high permeability material fixed to opposite sides of the contact rod and projecting laterally therefrom in side-by-side relationship and (ii) a pair of bridging members of high permeability material located at opposite sides of the contact rod and each disposed to extend between the side-by-side segments when the segments are located in proximity to the bridging members. The bridging members are magnetically attracted toward the segments with a force that varies in magnitude inversely with the spacing therebetween when current flows through the contact rod. The bridging members are mounted for movement with said segments during the final portion of a circuit-breaker opening operation and during the initial portion of a circuit-breaker closing operation. Blocking means blocks the bridging members from moving toward said segments when the contacts are engaged and maintains a relatively large spacing between the segments and the bridging members when the contacts are engaged. The bridging members when so blocked are positioned in the path of movement of said segments during a circuit-breaker opening operation and in such a location that the spacing between the segments and the bridging members decreases during the initial portion of a circuit-breaker opening operation.

BRIEF DESCRIPTION OF DRAWINGS

For a better understanding of the invention, reference may be had to the following drawings, wherein.

DETAILED DESCRIPTION OF PREFERRED EMBODIMENT

Figure 1:
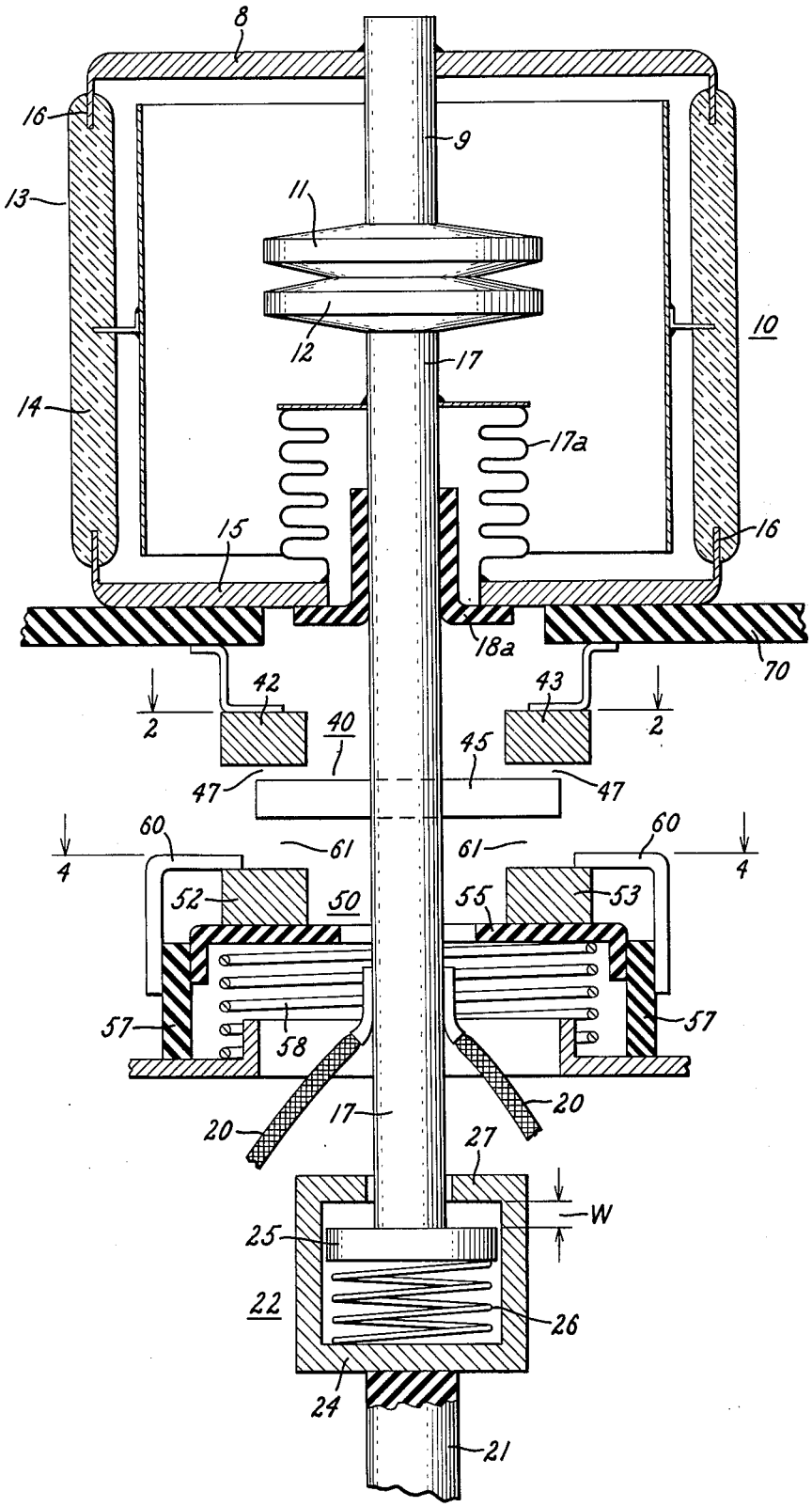
FIG. 1 is a side elevational view, partly in section, showing a circuit breaker embodying one form of my invention. The circuit breaker is shown in its fully-closed position.

Referring now to FIG. 1, there is shown a circuit interrupter 10 comprising a pair of separable contacts 11 and 12. Contact 11 is a stationary contact, and contact 12 is a movable contact that is vertically movable into and out of engagement with the stationary contacts. In FIG. 1, the circuit breaker is shown in its fully-closed position, where contact 12 engages contact 11. Opening of the circuit breaker is effected by driving contact 12 from its position of FIG. 1 downwardly into its fully-open position of FIG. 3. Closing is effected by returning contact 12 from its position of FIG. 3 to its position of FIG. 1.

Although this invention, in its broader aspects, is applicable to other types of circuit breakers, we have shown it embodied in a circuit breaker of the vacuum-type. Accordingly, the contacts 11 and 12 are shown located inside a highly evacuated envelope 13 comprising a cylindrical insulating casing 14 and upper and lower end caps 8 and 15 respectively joined thereto by vacuum tight seals 16. Stationary contact 11 is mounted on a stationary conductive contact rod 9 that is integrally joined to the upper end cap 8. Movable contact 12 is mounted on a movable conductive contact rod 17 that projects freely through lower end cap 15. A flexible metallic bellows 17*a* permits vertical movement of rod 17 without impairing the vacuum inside envelope 13.

Current through the interrupter follows a path that extends downwardly through stationary contact rod 9, the contacts 11 and 12, and movable contact rod 17. Current enters and leaves the movable contact rod 17 through flexible conductive braids 20 joined to the contact rod 17 at its lower end.

The interrupter is mounted on a stationary frame 70 to which the lower end plate 15 is appropriately attached. A suitable slide bearing 18*a* is fixed to the end plate 15 and serves to guide the movable contact rod 17 along a substantially straight-line vertical path.

For operating the interrupter between its open and closed positions, there is provided an operating rod 21 of insulating material and a wipe device 22 of conventional form coupling the operating rod to contact rod 17. Wipe device 22 comprises a driving part in the form of a cylindrical carriage 24 coupled to operating rod 21 and a driven part in the form of a piston 25 coupled to contact rod 17 and slidably mounted with the bore of cylindrical carriage 24. Also disposed within the bore of carriage 24 is a precompressed wipe spring 26 which urges piston 25 upwardly toward engagement with an annular stop 27 on the carriage. When carriage 24 is driven in an upward direction from its fully-open position of FIG. 3, piston 25 also moves upwardly, carrying movable contact 12 toward stationary contact 11. During this closing stroke, precompressed spring 26 holds piston 25 in engagement with annular stop 27 until movable contact 12 engages stationary contact 11. This engagement between the contacts terminates upward motion of contact 12 and piston 25, but carriage 24 continues moving upwardly, further compressing spring 26 and separating stop 27 from piston 25 until upward motion of carriage 24 is finally terminated. The distance W moved by the carriage as it travels upwardly after the contacts engage is referred to hereinafter as "wipe" or "wipe-travel". This wipe-travel serves to provide a force that helps to hold the contacts in engagement after closing despite limited wear of the contacts that might have previously occurred. Thus, even if the contacts engage at a slightly later point in the closing stroke because of such contact wear, there will still be some wipe travel after contact engagement; and this will act to make available for holding the contacts closed the force stored in wipe spring 26 and any additional force produced by further compression of the spring during wipe.

Wipe device 22 functions during an opening operation to permit operating rod 21 to move downwardly through the entire wipe direction W while the contacts still remain in engagement. When this wipe travel has been exhausted, stop 27 strikes piston 25 and carries contact rod 17 downwardly with operating rod 21.

CLOSING-ASSIST MEANS

As pointed out hereinabove under Background when high current flows through the engaged contacts of a circuit breaker, high magnetic repulsion forces (referred to herein as contact-popping forces) are developed that tend to force the contacts apart. For assisting the circuit breaker in opposing these contact-popping forces, I provide closing-assist means that comprises an armature 40 and stationary bridging members 42 and 43. Armature 40 comprises a pair of spaced-apart armature segments 45 fixed to opposite sides of contact rod 17 and projecting laterally therefrom in side-by-side relationship. The two stationary bridging members 42 and 43 are located at opposite sides of the contact rod 17, and each is disposed to extend between the armature segments 45 when the contacts 11, 12 are closed, as illustrated in FIGS. 1 and 2.

Both the armature segments 45 and the bridging members 42, 43 are made of a high permeability material such as iron. Current flowing through the contact rod 17 develops magnetic flux around the rod which varies in density directly with the current through the rod. When the circuit breaker is in its closed position of FIG. 1, the iron members 42, 43 and 45 form a low-reluctance magnetic circuit around the contact rod for this flux. This magnetic circuit includes four gaps, one at the interface between the end of each segment 45 and the adjacent bridging member. Two of these gaps are designated 47 in FIG. 1. When the flux around contact rod 17 traverses this magnetic circuit, the armature segments 45 are urged toward the bridging members with a force varying directly with the square of the flux density, assuming no saturation of the iron. The gaps 47 are preferably made large enough so that, when the circuit breaker is in its closed position of FIG. 1, the iron in the magnetic circuit does not saturate even at very high currents. It will therefore be apparent that at high currents a relatively large hold-closed force is developed to oppose the contact-popping forces. It will also be understood that the closing force developed by the closing-assist means varies in magnitude inversely with the length of gaps 47.

Figure 2:
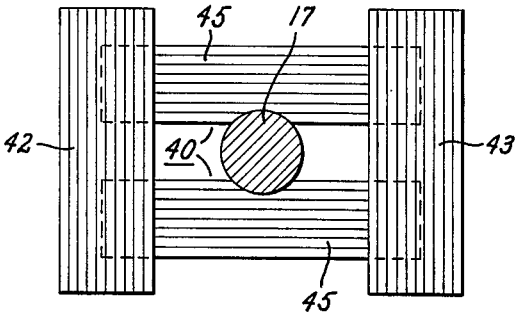
FIG. 2 is a sectional view taken along the line 2—2 of FIG. 1.

The armature segments 45 and bridging members 42, 43 are preferably suitably laminated, as shown in FIG. 2, so as to reduce the eddy currents induced in them by the time varying flux traversing the magnetic circuit, thus reducing eddy-current heating and power losses.

INITIATING AN OPENING OPERATION

The closing force developed by the closing-assist means tends to oppose an opening operation, but I am able to overcome this closing force during opening by relying upon the impact forces developed by the wipe device 22 during the early stages of an opening operation. As pointed out hereinabove, when the operating rod 21 is driven downwardly through a downward opening stroke, the shoulder 27 on the carriage 24 impacts against the piston 25, delivering a downwardly-acting impact blow to piston 25 and the attached contact rod 17. This impact acts to separate contacts 11 and 12 and to drive the armature segments 45 away from the stationary bridging member 42, 43, thus lengthening gaps 47. When gaps 47 are thus lengthened, the magnetic attractive forces between segment 45 and the bridging members 42, 43 sharply drop, assuming the magnetic circuit is not then deeply saturated. This drop in closing force facilitates continued opening action.

OPENING-ASSIST MEANS

Figure 4:
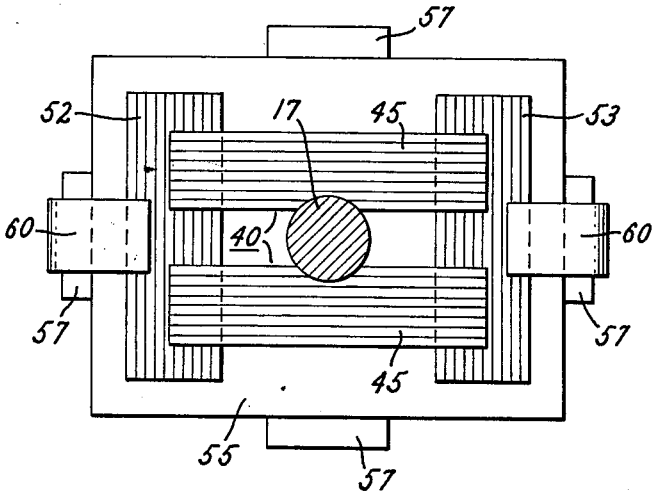
FIG. 4 is a sectional view along the line 4—4 of FIG. 1.

To prevent the armature 40 from bouncing back into proximity with the stationary bridging members 42, 43 after a short amount of downward travel in response to the above-described impact, opening-assist means 50 is provided. This opening-assist means comprises the above-described armature segments 45 and two additional bridging members 52 and 53 of high permeability material. These bridging members 52 and 53 are located on opposite sides of the contact rod 17, and each is disposed to extend between the side-by-side segments 45 when the segments are located in proximity to the bridging members, as is best shown in FIG. 4. Bridging members 52 and 53 are mounted on and fixed to a transversely-extending support 55 of non-magnetic material. Support 55 is movable axially of the contact rod 17 and is guided for such movement by suitable guides, such as 57. A compression spring 58 beneath support 55 biases the support upwardly into engagement with suitable stationary stops 60. When the circuit breaker is closed, there is a relatively large gap 61 between the armature segments 45 and bridging means 52 and 53, thus limiting to a low level the force of magnetic attraction between parts 45 and 52, 53 during this period. Generally speaking, this force of magnetic attraction varies in magnitude inversely with the spacing between parts 45 and 52, 53.

When the armature segments 45 move downwardly into proximity with bridging members 52, 53 following the above-described initial impact at the start of an opening operation, a high magnetic force of attraction is developed between bridging members 52, 53 and the armature segments 45. Since bridging members 52, 53 are restrained against upward motion by stops 60, this attractive force results in a large downward force being applied to the armature segments 45. Such downward force opposes any tendency of the armature segments to bounce back upwardly into proximity with stationary bridging members 42 and 43 and thus helps to continue the desired downward opening motion of contact rod 17. This downward magnetic force on the armature segments 45 is maintained until the segments move into contact with the lower bridging members 52, 53, at which point the bridging members are moved downwardly out of contact with stops 60, thus terminating the downward magnetic force on armature segments 45. Thereafter, and during the final portion of an opening operation, the armature segments 52, 53 and the bridging members 45 move downwardly together into their position of FIG. 3, where opening motion is terminated.

The above-described magnetic attractive force between the armature segments 45 and the lower bridging members 52, 53 is developed in substantially the same way as explained hereinabove in connection with the attractive force between the armature segments 45 and the upper bridging members 42, 43. That is, when the armature segments 45 move downwardly into proximity with the lower bridging members 52, 53 a magnetic circuit around contact rod 17 is defined by parts 45 and 52, 53, and the armature segments 45 tend to move into a position where this magnetic circuit will have a minimum reluctance. When the circuit breaker is in its closed position of FIG. 1, the gap at 47 is much smaller than the gap 61, and thus the attractive force between the armature segments 45 and the upper bridging members 42, 43 is much larger than that between the armature segments 45 and the lower bridging members 52, 53. But when the armature segments 45 are moved downwardly in response to the initial opening impact, the gap 47 increases while the gap 61 decreases, thus sharply reducing the upwardly-acting magnetic forces on armature segments 45 while increasing the downwardly-acting magnetic forces thereon.

A CLOSING OPERATION

Figure 3:
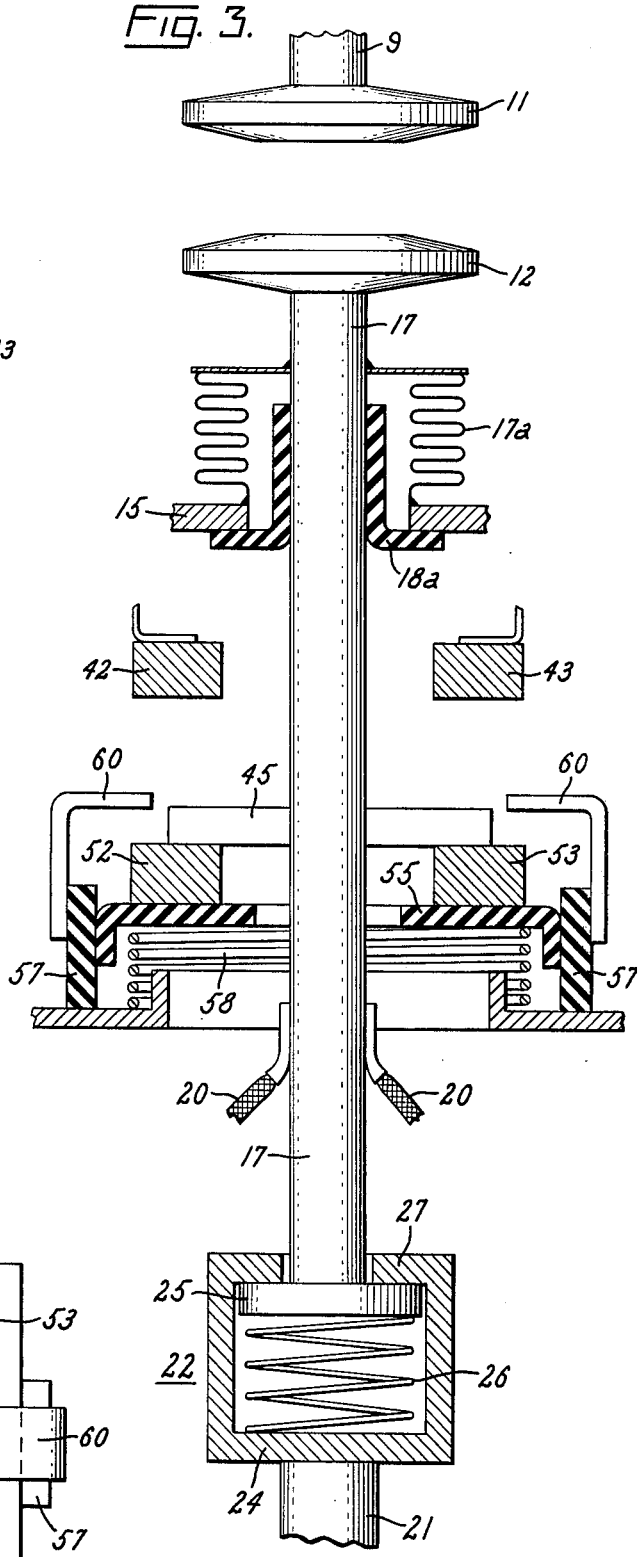
FIG. 3 is a side elevational view showing the circuit breaker of FIG. 1 in its fully open position.

During a closing operation, the contact rod 17 and armature segments 45 move upwardly from their position of FIG. 3 into their position of FIG. 1. The movable bridging members 52, 53 move upwardly with the armature segments 45 during the first portion of this closing stroke, but upward motion of the bridging members 52, 53 is terminated when they strike the stops 60. Thereafter, the armature segments 45 continue moving upwardly, establishing the gaps 61 of FIG. 1. Since there is normally no current through the contact rod 17 during a closing operation except at the very end of a closing stroke when the contacts 11, 12 engage or are in close proximity, no magnetic attractive force to oppose such closing action is developed between the armature segments 45 and lower bridging members 52, 53. When current through the interrupter is initiated at the end of the closing operation, an attractive force is immediately developed between armature segments 45 and stationary bridging members 42, 43 which helps to close, or hold closed, the contacts 11, 12 against magnetic repulsion, or popping, forces developed at the contacts.

GENERAL DISCUSSION

It will be apparent from the drawing and the above description that my magnetic-assist means is a simple device requiring only a few moving parts beyond those otherwise required in a circuit breaker of this general type. The electric circuit through the magnetic assist device is of a simple configuration inasmuch as it is constituted basically by the simple, straight contact rod 17. No current carrying pivots or the like are required, and the only conductive braids are those typically used (at 20) to constitute the terminal structure of such an interrupter and another (not shown but conventional) for connecting the lower end cap 15 to the movable contact rod 17.

It will be apparent that during an opening operation I am able to defeat the closing magnetic-assist means by relying upon the opening impact developed in the wipe device, the elimination of the closing force of the wipe spring 26 when parts 27 and 25 of the wipe device engage, and also the supplemental opening force provided by the magnetic attraction between armature segments 45 and bridging members 52, 53 of the opening-assist means.

While I have shown and described a particular embodiment of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. In an electric circuit breaker, a. a first contact and a second contact movable into and out of engagement with said first contact, b. a movable contact rod mechanically and electrically connected to said second contact for carrying current to and from said second contact, c. closing-assist means for exerting on said contact rod when the contacts are engaged a magnetic hold-closed force varying in magnitude directly with current through said contact rod, d. opening means effective during the initial portion of an opening operation for applying an impact force to said contact rod that acts to separate said contacts and to reduce the effectiveness of said closing-assist means, e. opening-assist means effective after said contacts are separated during an opening operation for developing magnetic force acting on said contact rod in an opening direction comprising:

$e_1$. an armature comprising spaced segments of high permeability material fixed to opposite sides of said contact rod and projecting laterally therefrom in side-by-side relationship, $e_2$. a pair of bridging members of high permeability material located at opposite sides of said contact rod and each disposed to extend between said side-by-side segments when said segments are located in proximity to said bridging members, f. said bridging members and said segments being magnetically attracted toward each other with a force that varies in magnitude inversely with the spacing therebetween when current flows through said contact rod, g. means mounting said bridging members for movement with said segments during the final portion of a circuit-breaker opening operation and during the initial portion of a circuit-breaker closing operation, h. blocking means for blocking said bridging members from moving toward said segments when said contacts are engaged and for maintaining a relatively large spacing between said segments and said bridging members when said contacts are engaged, i. said bridging members when blocked by said blocking means being positioned in the path of movement of said segments during a circuit-breaker opening operation and in such a location that the spacing between said segments and said bridging members decreases during the initial portion of a circuit-breaker opening operation.

2. The circuit breaker of claim 1 in which:

a. said closing-assist means comprises:

$a_1$. said side-by-side segments fixed to said contact rod, $a_2$. a pair of stationary bridging members of high permeability material located at opposite sides of said movable contact rod and each disposed to extend between said segments when said contacts are engaged, and b. said segments are movable during a circuit-breaker closing stroke from a position relatively remote from said stationary bridging members to a position in proximity with said stationary bridging members and are returnable during a circuit-breaker opening operation to said relatively remote position.

3. The circuit breaker of claim 2 in which: when said contacts are engaged, said segments are located substantially closer to said stationary bridging members than to said bridging members of said opening-assist means, whereby said closing-assist means then develops a substantially larger force on said contact rod acting in a closing direction that the magnetic force developed on said contact rod by said opening-assist means acting in an opening direction.

4. The circuit breaker of claim 3 in which during the initial portion of an opening operation, the spacing between said segments and said stationary bridging members increases while the spacing between said segments and said other bridging members decreases.

5. A vacuum-type circuit breaker constructed as defined in claim 1 and in which:

a. said contacts are located in a highly evacuated envelope, and b. said opening means comprises a wipe device comprising:

$b_1$. a wipe spring that exerts a closing force on said contacts while the contacts are engaged, $b_2$. and means for terminating transmission of said closing force to said contacts when said impact force is applied to said contact rod to separate said contacts.

6. In an electric circuit breaker, a. a first contact and a second contact movable into and out of engagement with said first contact, b. a movable contact rod mechanically and electrically connected to said second contact for carrying current to and from said second contact, c. closing-assist means for exerting on said contact rod when the contacts are engaged a magnetic hold-closed force varying in magnitude directly with current through said contact rod, d. opening means effective during the initial portion of an opening operation for applying an impact force to said contact rod that acts to separate said contacts and to reduce the effectiveness of said closing-assist means, e. said closing-assist means comprising:

$e_1$. an armature comprising spaced segments of high permeability material fixed to opposite sides of said contact rod and projecting laterally therefrom, $e_2$. a pair of stationary bridging members of high permeability material located at opposite sides of said movable contact rod and each extending between said segments when said contacts are engaged, $e_3$. said segments being located in proximity to but slightly spaced from said bridging members when said contacts are engaged so that said bridging members and said segments define a high permeability magnetic circuit around said contact rod for flux resulting from current through said contact rod, said magnetic circuit comprising the series combination of one said segments, one of said bridging members, the other of said segments, the other of said bridging members, and short gaps between said segments and said bridging members.

* * * * *